US010658719B2

(12) United States Patent
Liao et al.

(10) Patent No.: US 10,658,719 B2
(45) Date of Patent: May 19, 2020

(54) PHASE SHIFTER AND ANTENNA

(71) Applicant: Huawei Technologies Co., Ltd., Shenzhen (CN)

(72) Inventors: Zhiqiang Liao, Shenzhen (CN); Qiyi Lu, Shenzhen (CN); Xinneng Luo, Dongguan (CN); Tiejun Yang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 125 days.

(21) Appl. No.: 15/795,561

(22) Filed: Oct. 27, 2017

(65) Prior Publication Data

US 2018/0090838 A1 Mar. 29, 2018

Related U.S. Application Data

(63) Continuation of application No. PCT/CN2016/080035, filed on Apr. 22, 2016.

(30) Foreign Application Priority Data

Apr. 29, 2015 (CN) ..... 2015 1 0212058

(51) Int. Cl.
*H01P 1/18* (2006.01)
*H01Q 3/32* (2006.01)

(52) U.S. Cl.
CPC ..... *H01P 1/184* (2013.01); *H01Q 3/32* (2013.01)

(58) Field of Classification Search
CPC ..... H01P 1/184; H01P 5/08; H01Q 1/246; H01Q 3/04; H01Q 3/32
USPC ..... 333/24 R, 139, 156, 161
See application file for complete search history.

(56) References Cited

U.S. PATENT DOCUMENTS

| | | | | |
|---|---|---|---|---|
| 7,068,236 | B2 | 6/2006 | Pallone et al. | |
| 2004/0246175 | A1 | 12/2004 | Thomas | |
| 2008/0024385 | A1* | 1/2008 | Zimmerman | H01Q 1/243 343/905 |
| 2011/0140805 | A1 | 6/2011 | Liu et al. | |
| 2015/0116180 | A1 | 4/2015 | Wu | |
| 2017/0179594 | A1 | 6/2017 | Liao et al. | |
| 2017/0288306 | A1 | 10/2017 | Sledkov et al. | |

FOREIGN PATENT DOCUMENTS

| | | | |
|---|---|---|---|
| CN | 2845197 | Y | 12/2006 |
| CN | 2859838 | Y | 1/2007 |
| CN | 101174729 | A | 5/2008 |
| CN | 201181729 | Y | 1/2009 |

(Continued)

*Primary Examiner* — Robert J Pascal
*Assistant Examiner* — Jorge L Salazar, Jr.
(74) *Attorney, Agent, or Firm* — Slater Matsil, LLP

(57) ABSTRACT

A phase shifter and an antenna, in the field of communications technologies. The phase shifter includes a cavity, and a fixed component, a sliding component, a control rod configured to control sliding of the sliding component, and a dielectric portion in the cavity. A first strip group is disposed in the fixed component, where the first strip group includes two strips. The sliding component is located above the fixed component, and a second strip group is disposed in the sliding component. The second strip group includes two strips, and the two strips of the second strip group are electrically coupled to the two strips of the first strip group respectively.

16 Claims, 4 Drawing Sheets

(56) References Cited

FOREIGN PATENT DOCUMENTS

| | | | |
|---|---|---|---|
| CN | 101521312 | A | 9/2009 |
| CN | 102157767 | A | 8/2011 |
| CN | 102377024 | A | 3/2012 |
| CN | 102570033 | A | 7/2012 |
| CN | 203631728 | U | 6/2014 |
| CN | 203721853 | U | 7/2014 |
| CN | 203787537 | U | 8/2014 |
| CN | 104103875 | A | 10/2014 |
| CN | 104269647 | A | 1/2015 |
| CN | 104466405 | A | 3/2015 |
| JP | 2008271297 | A | 11/2008 |
| RU | 2257648 | C1 | 7/2005 |

* cited by examiner

PHASE SHIFTER AND ANTENNA

CROSS-REFERENCE TO RELATED APPLICATIONS

This application is a continuation of International Application No. PCT/CN2016/080035, filed on Apr. 22, 2016, which claims priority to Chinese Patent Application No. 201510212058.7, filed on Apr. 29, 2015. The disclosures of the aforementioned applications are hereby incorporated by reference in their entireties.

TECHNICAL FIELD

The present application relates to the field of communications technologies, and in particular, to a phase shifter and an antenna.

BACKGROUND

A phase shifter is an apparatus that can adjust a phase of a wave. It is a key part of an antenna. The phase shifter changes a directivity pattern of the antenna by changing a phase of a signal arriving at the antenna, thereby achieving a purpose of remotely controlling a network coverage area.

An existing phase shifter generally includes a fixed printed circuit board (PCB) and a sliding metal. A fixed circuit is disposed in the fixed PCB, and the sliding metal is in a U shape. When the sliding metal slides relative to the fixed circuit, a phase of a current passing through the fixed circuit changes.

During implementation of the present application, the inventor finds that the prior art has at least the following problem: When a required phase shift amount is relatively large, lengths of a sliding metal and a fixed circuit need to be increased correspondingly, and a phase shifter becomes larger in size.

SUMMARY

To resolve a problem in the prior art that a phase shifter is relatively large in size, embodiments of the present application provide a phase shifter and an antenna. The technical solutions are as follows:

According to a first aspect, a phase shifter is provided, where the phase shifter includes a cavity, and a fixed component, a sliding component, a control rod configured to control sliding of the sliding component, and a dielectric portion in the cavity, where a first strip group is disposed in the fixed component, where the first strip group includes two strips. The sliding component is located above the fixed component, and a second strip group is disposed in the sliding component, where the second strip group includes two strips, the two strips of the second strip group are electrically coupled to the two strips of the first strip group respectively, and the second strip group is in a U shape, and each strip of the first strip group and/or the second strip group includes a first strip portion and a second strip portion, a width of the first strip portion is greater than a width of the second strip portion, the dielectric portion is disposed around the second strip portion, and a difference between an impedance formed by the dielectric portion and the second strip portion and an impedance of the first strip portion is within a first range.

In a first possible implementation manner of the first aspect, the dielectric portion includes a first dielectric portion and a second dielectric portion, where the first dielectric portion is located above the sliding component and is within a moving range of the second strip portion, and the second dielectric portion is located below the sliding component and is within the moving range of the second strip portion.

With reference to the first aspect or the first possible implementation manner of the first aspect, in a second possible implementation manner, a dielectric constant of the dielectric portion is within a second range, and the dielectric constant has a negative correlation with the width of the second strip portion.

In a third possible implementation manner of the first aspect, the two strips of the first strip group and/or the two strips of the second strip group are strips having a plated hole.

In a fourth possible implementation manner of the first aspect, the two strips of the first strip group and/or the two strips of the second strip group are strips plated with a metal on both sides.

In a fifth possible implementation manner of the first aspect, there are at least two cavities, and at least two cavities of the at least two cavities share a same ground cable.

In a sixth possible implementation manner of the first aspect, the phase shifter further includes an elastic part located between the first strip group and the second strip group, a distance between the first strip group and the second strip group is restricted by the elastic part and falls within a preset range, and the preset range is a distance range required when the first strip group is electrically coupled to the second strip group.

In a seventh possible implementation manner of the first aspect, there are at least two second strip groups, and the at least two second strip groups are disposed in a same direction or in opposite directions.

With reference to any one of the first aspect or the first to the seventh possible implementation manners of the first aspect, in an eighth possible implementation manner, a strip that is of the first strip group and that is configured to output a signal is electrically connected to a radiation unit of an antenna.

According to a second aspect, an antenna is provided, where the antenna includes the phase shifter according to the first aspect or any possible implementation manner of the first aspect.

The technical solutions provided in the embodiments of the present application bring the following beneficial effects.

A first strip portion and a second strip portion of different widths are disposed in a strip of a first strip group and/or a second strip group, and a dielectric portion is disposed around the second strip portion of a smaller width. A dielectric constant is increased by using the dielectric portion, to further increase a phase shift amount. This resolves a problem in the prior art that a phase shifter is relatively large in size when a relatively large phase shift amount is required, and can reduce a size of the phase shifter.

BRIEF DESCRIPTION OF THE DRAWINGS

To describe the technical solutions in the embodiments of the present application more clearly, the following briefly describes the accompanying drawings required for describing the embodiments. Apparently, the accompanying drawings in the following description show merely some embodiments of the present application, and a person of ordinary skill in the art may still derive other drawings from these accompanying drawings without creative efforts.

DETAILED DESCRIPTION OF ILLUSTRATIVE EMBODIMENTS

To make the objectives, technical solutions, and advantages of the present application clearer, the following further describes the embodiments of the present application in detail with reference to the accompanying drawings.

Figure 1A:
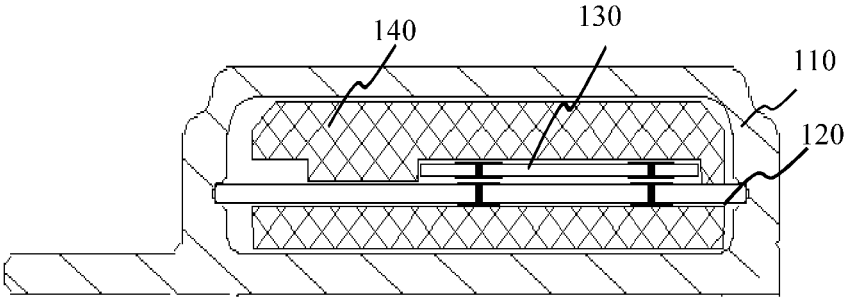
FIG. 1A is a sectional view of a phase shifter according to an embodiment of the present application.

Referring to FIG. 1A, FIG. 1A shows a sectional view of a phase shifter according to an embodiment of the present application. As shown in FIG. 1A, the phase shifter may include a cavity 110, and a fixed component 120, a sliding component 130, a control rod (not shown in the figure) configured to control sliding of the sliding component 130, and a dielectric portion 140 in the cavity 110.

Figure 1B:
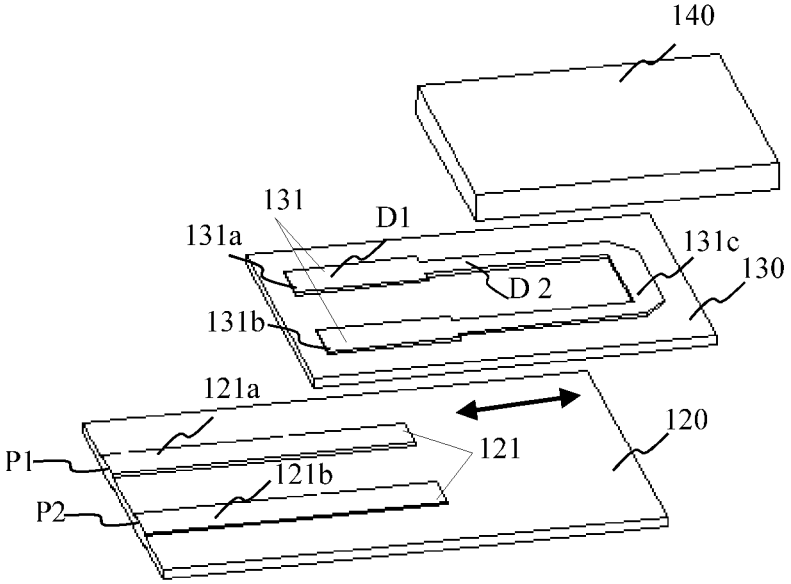
FIG. 1B is a three-dimensional diagram of components of a phase shifter according to an embodiment of the present application.

Referring to FIG. 1B, a first strip group 121 is disposed in the fixed component 120, and the first strip group 121 includes two strips 121*a* and 121*b*. Optionally, a groove is disposed on two sides of the cavity 110, and the fixed component 120 is fastened in the cavity 110 by using the grooves.

Optionally, there may be two or more first strip groups 121. A designer may set a quantity of the first strip groups 121 according to a quantity of output ports required by the phase shifter.

The sliding component 130 is located above the fixed component 120. The sliding component 130 is in a sliding state under control of the control rod. For example, referring to FIG. 1B, the sliding component 130 slides, under the control of the control rod, left and right along an arrow direction shown in the figure. Optionally, the control rod may be fastened in the cavity 110, and the sliding component 130 is disposed in the cavity 110 by using the control rod.

Referring to FIG. 1B, a second strip group 131 is disposed in the sliding component 130. The second strip group 131 includes two strips 131*a* and 131*b*. The two strips 131*a* and 131*b* of the second strip group 131 may be connected by using 131*c* to form a U shape. In addition, a quantity of the second strip groups 131 is the same as the quantity of the first strip groups 121. Two strips of each second strip group 131 are electrically coupled to two strips of the first strip group 121 respectively.

Each strip of the first strip group 121 and/or the second strip group 131 includes a first strip portion D1 and a second strip portion D2. A width of the first strip portion D1 is greater than a width of the second strip portion D2. The dielectric portion 140 is disposed around the second strip portion D2. A difference between an impedance formed by the dielectric portion 140 and the second strip portion D2 and an impedance of the first strip portion D1 is within a first range (only an example in which the first strip portion D1 and the second strip portion D2 are disposed in a strip of the second strip group 131 is used for description in the figure).

It should be noted that, the first strip portion D1 may have at least one width, the second strip portion D2 may also have at least one width, and a minimum width of the first strip portion D1 is greater than a maximum width of the second strip portion D2. This embodiment sets no limitation thereto.

In addition, referring to FIG. 1B, in an example in which P1 is an input port of the phase shifter and P2 is an output port of the phase shifter, after the sliding component 130 slides under the control of the control rod, a phase of an electrical signal output from the P2 port changes correspondingly, thereby achieving a phase-shift purpose.

It should be further noted that, the fixed component in this embodiment may be a fixed PCB, and the sliding component may be a sliding PCB. This embodiment sets no limitation thereto.

In conclusion, according to the phase shifter provided in this embodiment, a first strip portion and a second strip portion of different widths are disposed in a strip of a first strip group and/or a second strip group, and a dielectric portion is disposed around the second strip portion of a smaller width. A dielectric constant is increased by using the dielectric portion, to further increase a phase shift amount. This resolves a problem in the prior art that a phase shifter is relatively large in size when a relatively large phase shift amount is required, and can reduce a size of the phase shifter.

Figure 2A:
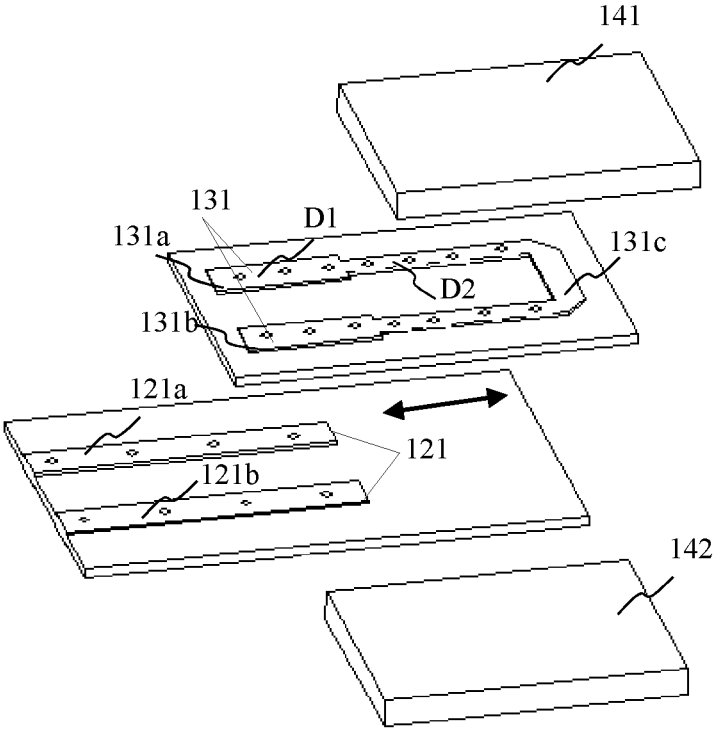
FIG. 2A is a three-dimensional diagram of partial components of a phase shifter according to an embodiment of the present application.

As shown in FIG. 2A, the dielectric portion 140 of the phase shifter provided in the foregoing embodiment may include a first dielectric portion 141 and a second dielectric portion 142.

The first strip portion D1 and the second strip portion D2 are disposed in the strip of the second strip group 131. The first dielectric portion 141 is located above the sliding component 130 and is within a moving range of the second strip portion D2.

Specifically, because the sliding component 130 may be in a sliding state under control of the control rod, to allow the first dielectric portion 141 to always affect the second strip portion D2, the first dielectric portion 141 may be disposed above the sliding component 130 and disposed within the moving range of the second strip portion D2. The moving range of the second strip portion D2 is a distance range between the positions of the second strip portion D2 when the sliding component 130 is at a starting position and when the sliding component 130 slides to a maximum position.

Similarly, the second dielectric portion 142 is located below the sliding component 130 and is within the moving range of the second strip portion D2.

It should be noted that only an example in which the dielectric portion 140 is disposed according to the foregoing manner is used in this embodiment. Optionally, the dielectric portion 140 may be further located at another position provided that a difference between an impedance formed by the dielectric portion 140 and the second strip portion D2 and an impedance of the first strip portion D1 is within a first range. Optionally, a dielectric corresponding to the first dielectric portion 141 and a dielectric corresponding to the second dielectric portion 142 may be the same or different provided that dielectric constants of the two dielectrics are greater than 1, that is, a dielectric constant of an environment in which the second strip portion D2 is located can be increased.

In addition, because the difference between the impedance formed by the second strip portion D2 and the dielectric portion 140 and the impedance of the first strip portion D1 needs to be within the first range, a smaller width of the second strip portion D2 indicates a larger dielectric constant required by the dielectric portion 140, that is, a dielectric constant of the dielectric portion 140 has a negative correlation with the width of the second strip portion D2. However, because electrical performance of the second strip portion D2 may deteriorate when the width of the second strip portion D2 is less than a preset threshold, the dielectric constant of the dielectric portion 140 in this embodiment is generally within a second range. The second range is generally 3 to 10.

In addition, only an example in which the first strip portion D1 and the second strip portion D2 are disposed in the strip of the second strip group 131 is used in FIG. 2A. Optionally, a first strip portion D1 and a second strip portion D2 may also be disposed in a strip of the first strip group 121 by using a similar disposing manner. Details are not further described in this embodiment.

Optionally, two strips of the first strip group 121 and/or two strips of the second strip group 131 are strips having a plated hole. The use of the strips having a plated hole allows the dielectric portion 140 to be close to the sliding component 130 or the fixed component 120 to most extent. This increases a dielectric constant within the sliding range of the sliding component 130, that is, increases a phase shift amount within the same sliding range, and reduces a size of the phase shifter.

Optionally, two strips of the first strip group 121 and/or two strips of the second strip group 131 are strips plated with a metal on both sides. The use of the strips plated with a same metal on both sides allows the strips to be less sensitive to a temperature, so that the strips can be kept flat within any temperature range (same metals have a same thermal expansion and contraction under a same temperature, and the strips are relatively flat). The two strips of the first strip group 121 and/or the two strips of the second strip group 131 may be strips plated with copper on both sides.

Figure 2B:
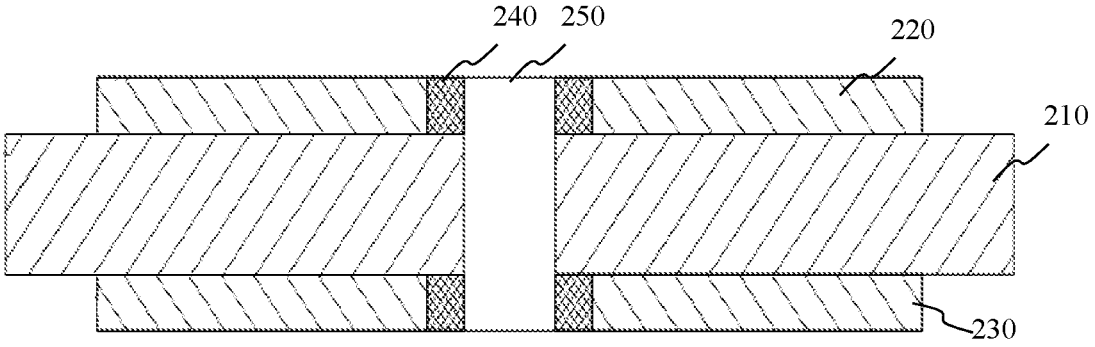
FIG. 2B is a sectional view of a strip having a plated hole according to an embodiment of the present application.

For example, referring to FIG. 2B, FIG. 2B shows a sectional view of a strip 131*a* (a strip 131*b* has a same structure as the strip 131*a*) of the sliding component 130. As shown in FIG. 2B, 210 is a body of the strip 131*a*, 220 and 230 are copper plated on both sides of the strip 131*a*, 240 is a metal used for a plated hole, and 250 is the plated hole.

Optionally, there may be at least two cavities 110, and at least two cavities 110 of the at least two cavities 110 share a same ground cable. A quantity of the cavities 110 is generally determined by a quantity of antenna arrays in an antenna used by the phase shifter.

At least two cavities 110 of the at least two cavities 110 are set to share the same ground cable, so that there is no need to set a ground cable for each cavity 110. This reduces a thickness of the phase shifter, and further reduces the size of the phase shifter.

Figure 2C:
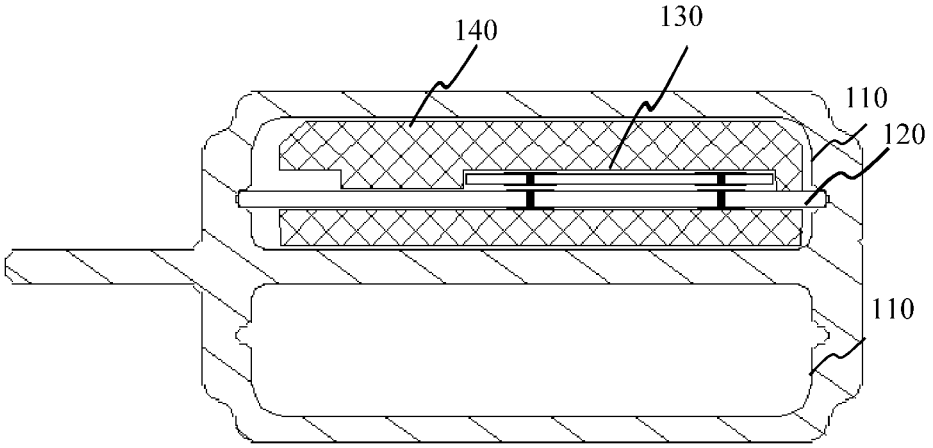
FIG. 2C is a sectional view of a phase shifter including two cavities according to an embodiment of the present application.

For example, there are two cavities 110. Referring to FIG. 2C, FIG. 2C shows a sectional view of a phase shifter including two cavities 110. As shown in FIG. 2C, the two cavities no form a ladder or "日" shape, and share a same ground cable in the middle of the ladder or "日" shape. This reduces the thickness of the phase shifter, and further reduces the size of the phase shifter. The upper and lower cavities 110 in FIG. 2C have a same inner structure. The figure shows only the inner structure of the upper cavity, and does not show the inner structure of the lower cavity.

Optionally, a specific distance between the first strip group 121 and the second strip group 131 needs to be ensured when the first strip group 121 is electrically coupled to the second strip group 131. To ensure that the two can be electrically coupled to each other, the phase shifter may further include an elastic part 150 located between the first strip group 121 and the second strip group 131. In this way, the first strip group 121 and the second strip group 131 are restricted by the elastic part 150, so that the distance between the first strip group 121 and the second strip group 131 falls within a preset range. The preset range is a distance range required when the first strip group 121 is electrically coupled to the second strip group 131.

Figure 2D:
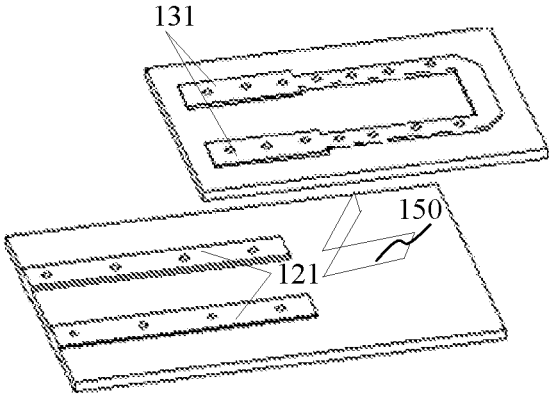
FIG. 2D is a schematic diagram of a position relationship between a first strip group, a second strip group, and an elastic part according to an embodiment of the present application.

For example, referring to FIG. 2D, FIG. 2D shows a position relationship between the first strip group 121, the second strip group 131, and the elastic part 150.

It should be noted that, to avoid an impact of the elastic part 150 on electrical coupling of the first strip group 121 to the second strip group 131, a material of the elastic part 150 is generally an insulator, or an object having a relatively small dielectric constant. This embodiment sets no limitation thereto.

Optionally, there may be at least two second strip groups 131, and the at least two second strip groups 131 are disposed in a same direction or in opposite directions. Moreover, when there are at least two second strip groups 131, there may also be at least two first strip groups 121 correspondingly. In this way, strips of each second strip group 131 are electrically coupled to strips of the first strip group 121 respectively.

Figure 2E:
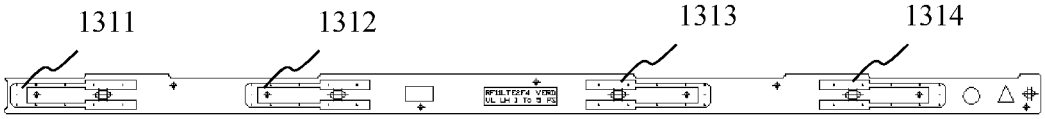
FIG. 2E is a schematic diagram of a position relationship between second strip groups according to an embodiment of the present application.
Figure 2F:
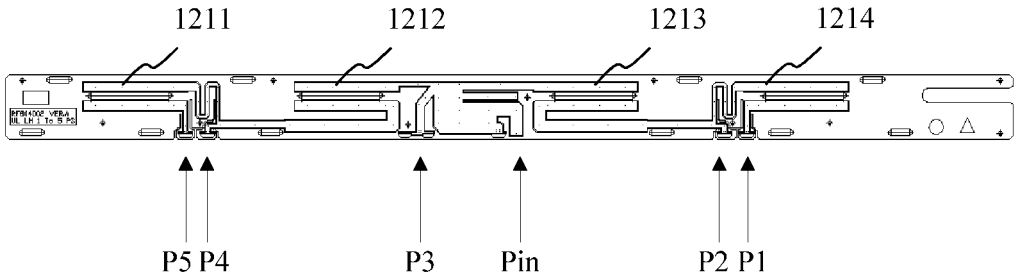
FIG. 2F is a schematic diagram of a position relationship between first strip groups according to an embodiment of the present application.

For example, there are four second strip groups 131 (1311, 1312, 1313, and 1314) and the four second strip groups 131 are disposed in opposite directions. Referring to FIG. 2E, FIG. 2E shows a schematic diagram of a position relationship between the four second strip groups 131. Correspondingly, referring to FIG. 2F, FIG. 2F shows a schematic diagram of a position relationship between four first strip groups 121 (1211, 1212, 1213, and 1214). With reference to FIG. 2D and FIG. 2E, the second strip group 1311 is electrically coupled to the first strip group 1211, the second strip group 1312 is electrically coupled to the first strip group 1212, the second strip group 1313 is electrically coupled to the first strip group 1213, and the second strip group 1314 is electrically coupled to the first strip group 1214.

Figure 2G:
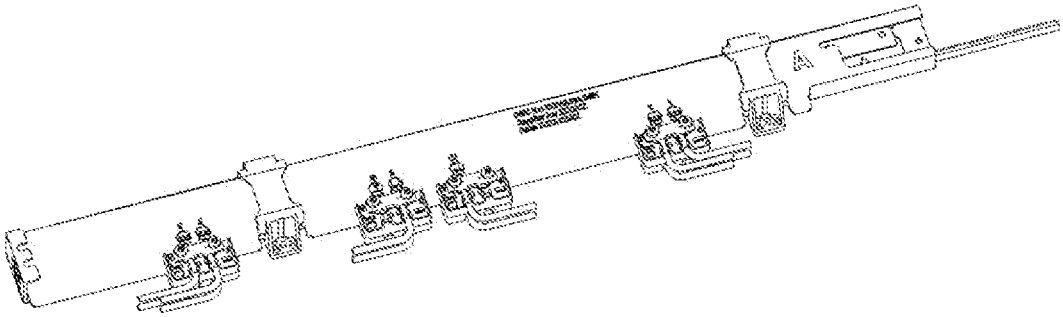
FIG. 2G is a three-dimensional diagram of a cavity of a phase shifter according to an embodiment of the present application.

In addition, referring to FIG. 2G, FIG. 2G shows a three-dimensional schematic diagram of a cavity 110 of a phase shifter when there are four second strip groups 131.

Each second strip group 131 is electrically coupled to each first strip group 121, so that a signal input from an input port can be transmitted to each output port according to a requirement. Specifically, to achieve an equal difference or an approximately equal difference between phases output by output ports, each second strip group 131 may be disposed in opposite directions, for example, in a manner shown in FIG. 2E.

Referring to FIG. 2F, in an example in which Pin is an input port, a signal is input from the Pin port. Because a P5 output port is serially connected to the first strip group 1211 and the second strip group 1311 behind a P4 output port, a phase difference generated by the P5 output port is twice a phase difference generated by the P4 output port. Similarly, a phase difference of a P1 output port is twice a phase difference of a P2 output port. Phases output from P5, P4, P3, P2, and P1 ports are 2φ, φ, 0, −φ, and −2φ, respectively.

Optionally, a strip that is of the first strip group 121 and that is configured to output a signal is electrically connected to a radiation unit of an antenna. In this way, the phase shifter can adjust points of a directivity pattern of the antenna. For example, with reference to FIG. 2E, P5, P4, P3, P2, and P1 may be electrically connected to the radiation unit of the antenna separately.

It should be additionally noted that, for power of an input signal, power distribution can be implemented by adjusting a power division circuit between each pair of the first strip group 121 and the second strip group 131. This embodiment sets no limitation thereto.

In conclusion, according to the phase shifter provided in this embodiment, a first strip portion and a second strip portion of different widths are disposed in a strip of a first strip group and/or a second strip group, and a dielectric portion is disposed around the second strip portion of a smaller width. A dielectric constant is increased by using the dielectric portion, to further increase a phase shift amount. This resolves a problem in the prior art that a phase shifter is relatively large in size when a relatively large phase shift amount is required, and can reduce a size of the phase shifter.

According to this embodiment, the use of a strip having a plated hole increases the phase shift amount of the phase shifter, and further reduces the size of the phase shifter. In addition, the use of a strip plated with a metal on both sides allows the strip to be less sensitive to a temperature and improves flatness of the strip.

In addition, according to this embodiment, at least two of at least two cavities share a same ground cable, so that there is no need to set a ground cable for each cavity. This reduces a thickness of the phase shifter, and further reduces the size of the phase shifter.

An embodiment of the present application provides an antenna, and the antenna may include the phase shifter provided in the foregoing embodiment. For specific technical details of the phase shifter, refer to the foregoing embodiment, and details are not further described in this embodiment.

In conclusion, according to the antenna provided in this embodiment, a first strip portion and a second strip portion of different widths are disposed in a strip of a first strip group and/or a second strip group, and a dielectric portion is disposed around the second strip portion of a smaller width. A dielectric constant is increased by using the dielectric portion, to further increase a phase shift amount. This resolves a problem in the prior art that a phase shifter is relatively large in size when a relatively large phase shift amount is required, and can reduce a size of the phase shifter.

According to this embodiment, the use of a strip having a plated hole increases the phase shift amount of the phase shifter, and further reduces the size of the phase shifter. In addition, the use of a strip plated with a metal on both sides allows the strip to be less sensitive to a temperature and improves flatness of the strip.

In addition, according to this embodiment, at least two of at least two cavities share a same ground cable, so that there is no need to set a ground cable for each cavity. This reduces a thickness of the phase shifter, and further reduces the size of the phase shifter.

The foregoing descriptions are merely specific implementation manners of the present application, but are not intended to limit the protection scope of the present application. Any variation or replacement readily figured out by a person skilled in the art within the technical scope disclosed in the present application shall fall within the protection scope of the present application. Therefore, the protection scope of the present application shall be subject to the protection scope of the claims.

What is claimed is:

1. A phase shifter, comprising:

a cavity;

a fixed component;

a sliding component;

a control rod configured to control sliding of the sliding component; and a dielectric portion in the cavity, the dielectric portion comprising a first dielectric portion and a second dielectric portion;

wherein a first strip group is disposed in the fixed component, wherein the first strip group comprises two strips;

wherein the sliding component is located above the fixed component, wherein a second strip group is disposed in the sliding component, wherein the second strip group comprises two strips, wherein the two strips of the second strip group are electrically coupled to the two strips of the first strip group respectively, and wherein the second strip group is in a U shape; and wherein each strip of the second strip group comprises a first strip portion and a second strip portion, wherein each second strip portion of the strips of the second strip group is electrically connected, by a third strip portion, to each other second strip portion, and wherein each second strip portion is disposed between the third strip portion and the first strip portion of the respective strip of the second strip group, wherein a width of the first strip portion is greater than a width of the second strip portion, wherein the dielectric portion is disposed around the second strip portion, and wherein a difference between an impedance formed by the dielectric portion and the second strip portion and an impedance of the first strip portion is within a first range; and wherein the first dielectric portion is located above the sliding component and is within a moving range of the second strip portions, and wherein the second dielectric portion is located below the sliding component and is within the moving range of the second strip portions.

2. The phase shifter according to claim 1, wherein a strip of the first strip group is configured to output a signal and is electrically connected to a radiation unit of an antenna.

3. The phase shifter according to claim 1, wherein a dielectric constant of the dielectric portion is within a second range.

4. The phase shifter according to claim 1, wherein the two strips of the first strip group or the two strips of the second strip group are strips having a plated hole.

5. The phase shifter according to claim 1, wherein the two strips of the first strip group or the two strips of the second strip group are strips plated with a metal on both sides.

6. The phase shifter according to claim 1, wherein the cavity comprises at least two cavities sharing a same ground cable.

7. The phase shifter according to claim 1, wherein the phase shifter further comprises an elastic part located between the first strip group and the second strip group, wherein a distance between the first strip group and the second strip group is restricted by the elastic part and falls within a preset range, and wherein the preset range is a distance range required when the first strip group is electrically coupled to the second strip group.

8. The phase shifter according to claim 1, wherein the second strip group comprises at least two second strip groups, and wherein the at least two second strip groups are disposed in a same direction or in opposite directions.

9. An antenna, comprising:

a phase shifter, the phase shifter comprising:

a cavity;

a fixed component;

a sliding component;

a control rod configured to control sliding of the sliding component; and a dielectric portion in the cavity, the dielectric portion comprising a first dielectric portion and a second dielectric portion;

wherein a first strip group is disposed in the fixed component, wherein the first strip group comprises two strips;

wherein the sliding component is located above the fixed component;

wherein a second strip group is disposed in the sliding component, wherein the second strip group comprises two strips, wherein the two strips of the second strip group are electrically coupled to the two strips of the first strip group respectively, and wherein the second strip group is in a U shape; and wherein each strip of the second strip group comprises a first strip portion and a second strip portion, wherein each second strip portion of the strips of the second strip group is electrically connected, by a third strip portion, to each other second strip portion, and wherein each second strip portion is disposed between the third strip portion and the first strip portion of the respective strip of the second strip group, wherein a width of the first strip portion is greater than a width of the second strip portion, wherein the dielectric portion is disposed around the second strip portion, and wherein a difference between an impedance formed by the dielectric portion and the second strip portion and an impedance of the first strip portion is within a first range; and wherein the first dielectric portion is located above the sliding component and is within a moving range of the second strip portions, and wherein the second dielectric portion is located below the sliding component and is within the moving range of the second strip portions.

10. The antenna according to claim 9, wherein the second strip group comprises at least two second strip groups, and wherein the at least two second strip groups are disposed in a same direction or in opposite directions.

11. The antenna according to claim 9, wherein a strip of the first strip group is configured to output a signal and is electrically connected to a radiation unit of an antenna.

12. The antenna according to claim 9, wherein a dielectric constant of the dielectric portion is within a second range.

13. The antenna according to claim 9, wherein the two strips of the first strip group or the two strips of the second strip group are strips having a plated hole.

14. The antenna according to claim 9, wherein the two strips of the first strip group or the two strips of the second strip group are strips plated with a metal on both sides.

15. The antenna according to claim 9, wherein the cavity comprises at least two cavities sharing a same ground cable.

16. The antenna according to claim 9, wherein the phase shifter further comprises an elastic part located between the first strip group and the second strip group, wherein a distance between the first strip group and the second strip group is restricted by the elastic part and falls within a preset range, and wherein the preset range is a distance range required when the first strip group is electrically coupled to the second strip group.

* * * * *